US006283422B1

(12) United States Patent
Stoelinga

(10) Patent No.: US 6,283,422 B1
(45) Date of Patent: Sep. 4, 2001

(54) DRIVE FOR MECHANICAL ADJUSTMENT OF PROFILE PARTS, PIECE OF FURNITURE, PROFILE PART AND METHOD FOR MANUFACTURING A PROFILE PART

(75) Inventor: Dirk Jan Stoelinga, Huizen (NL)

(73) Assignee: Actuall B.V. (NL)

( * ) Notice: Subject to any disclaimer, the term of this patent is extended or adjusted under 35 U.S.C. 154(b) by 0 days.

(21) Appl. No.: 09/460,741

(22) Filed: Dec. 14, 1999

(30) Foreign Application Priority Data

Dec. 15, 1998 (NL) ..... 1010808

(51) Int. Cl.[7] ..... F16M 11/24

(52) U.S. Cl. ..... 248/188.2; 74/89.17; 248/188.5; 297/362; 297/362.11; 297/330; 297/344.12; 297/344.18

(58) Field of Search ..... 248/188.2, 188.5, 248/405, 422, 157; 74/89.17, 89.13; 297/353, 362, 362.11, 367, 411.36, 311, 330, 344.12, 344.17, 344.18, 344.2

(56) References Cited

U.S. PATENT DOCUMENTS

| | | | | |
|---|---|---|---|---|
| 3,673,877 | * | 7/1972 | Lebre | 74/37 |
| 4,254,928 | * | 3/1981 | Huempfner | 248/422 |
| 4,627,591 | * | 12/1986 | Heckmann | 248/411 |
| 4,757,725 | * | 7/1988 | Beugin | 74/422 |
| 5,140,760 | * | 8/1992 | Mannbro | 37/444 |
| 5,234,187 | * | 8/1993 | Teppo et al. | 248/161 |
| 5,836,205 | * | 11/1998 | Meyer | 74/89.17 |
| 6,070,840 | * | 7/2000 | Kelley et al. | 248/188.4 |

FOREIGN PATENT DOCUMENTS

| | | | | |
|---|---|---|---|---|
| 3719012 | | 12/1988 | (DE) | A47B/37/02 |
| 4417337 | | 11/1995 | (DE) | A47B/9/06 |
| 426837A1 | * | 10/1990 | (FR) . | |
| 2166649A | * | 5/1986 | (GB) | 248/188.5 |
| 9916333 | | 4/1999 | (WO) | A47B/9/20 |

* cited by examiner

*Primary Examiner*—Anita King
*Assistant Examiner*—Holly N. Sy
(74) *Attorney, Agent, or Firm*—Webb Ziesenheim Logsdon Orkin & Hanson, P.C.

(57) ABSTRACT

A drive assembly for mechanically displacing and positioning two profile parts relative to each other includes at least one tooth path connected to a first profile part, at least one toothed wheel connected rotatably to a second profile part for engaging on the tooth path, drive means, and a transmission mechanism for transmitting to the toothed wheel the power produced by the drive means, wherein the transmission mechanism is provided with at least one right-angled transmission. Also disclosed is a piece of furniture provided with such a drive, a profile part for assembly with the drive and a method for manufacturing such a profile part.

14 Claims, 3 Drawing Sheets

DRIVE FOR MECHANICAL ADJUSTMENT OF PROFILE PARTS, PIECE OF FURNITURE, PROFILE PART AND METHOD FOR MANUFACTURING A PROFILE PART

BACKGROUND OF THE INVENTION

1. Field of the Invention

The invention relates to a drive for mechanically displacing and positioning two profile parts relative to each other. The invention also relates to a piece of furniture incorporating such a drive and to a profile part for assembly with the drive. Finally, the invention also relates to a method for manufacturing a profile part according to the invention.

2. Description of the Prior Art

Many solutions are known for height adjustment of objects, such as for instance tables, beds, machines and so on. Many of the applied constructions comprise one or more telescopic legs, the length of which is adjustable using for instance a screw spindle or toothed belt. A drawback of the existing mechanized drives for adjustment of the telescopic legs is that these are complex and therefore costly. An additional drawback is that the existing drives are generally bulky.

The present invention has for its object to provide a drive for displacing and positioning two profile parts relative to each other with which inter alia telescopic legs are adjustable without the above stated drawbacks of the prior art. The invention also has for its object to provide a relatively low-noise drive. In addition, the invention has the object of providing a piece of furniture provided with at least one such drive, a profile part for assembly with the drive and a method for manufacturing a profile part with which a compact, inexpensive and low-noise application of the drive is possible.

SUMMARY OF THE INVENTION

The invention provides for this purpose a drive for mechanically displacing and positioning two profile parts relative to each other, comprising: at least one tooth path connected to a first profile part, at least one toothed wheel connected rotatably to a second profile part for engaging on the tooth path, drive means and a transmission mechanism for transmitting to the toothed wheel the power produced by the drive means, wherein the transmission mechanism is provided with at least one right-angled transmission. The drive preferably comprises at least two tooth paths and at least two toothed wheels, wherein the toothed wheels are placed substantially parallel to each other, are rotatable in opposing directions and on opposite longitudinal sides of the profile part engage on respective tooth paths of the first profile part. A tooth path connected longitudinally to the profile part is also described as a gear rack. Through the engagement of the toothed wheel on the tooth path the drive provides rigidity to an assembly of profile parts in which the drive is incorporated. This extra rigidity is obtained particularly when the drive engages on a tooth path on both sides of the second profile part. In addition, the transmission can take a compact form; long elements such as screw spindle or drive belt are after all unnecessary. The component which is longer, the tooth path, is already integrated into the first profile part. An additional advantage thereof is that the length range over which adjustment is possible is limited to only a small extent by the construction height of the drive. The use of the right-angled transmission in the transmission mechanism has the advantage that a load on the transmission mechanism is taken up without this resulting in loading of the drive means. The transmission can hereby also be compact and inexpensive; separate measures for fixation of the transmission are unnecessary without this resulting in a considerable limitation of the efficiency of the transmission. A consequence hereof is that the drive means can also be kept compact, this furthermore being advantageous from considerations of cost and in respect of the noise produced by the drive.

The drive means, the transmission mechanism and the toothed wheel are preferably located substantially within the outer periphery of the second profile part and the second profile part is preferably also telescopically movable in and out of the first profile part. The drive can thus be fitted entirely into a profile part. In addition to efficient use of the generally unused inside of a profile, this also has the advantage of resulting in a further sound-damping on the outside of the profile part. This advantage is further reinforced when the second profile part is enclosed by the first profile part.

In another preferred embodiment the first profile part is provided with at least two tooth paths which are located substantially opposite and parallel to each other. This enables the drive to engage on the first profile at mutually opposite positions. This provides additional rigidity and results in a limited load on toothed wheels and tooth paths.

The drive means can comprise an electric motor which is widely available at limited cost. It is however also possible to provide the drive with pneumatic drive means, hydraulic drive means etc., subject to the use of the drive. For operation of the drive means these are provided with operating means, for instance in the form of a control panel with or without wiring for use remotely of the drive. The transmission mechanism is preferably provided with a reductor formed by tooth wheels and chains so that small electric motors with a relatively high rotation speed can be applied for adjustment of heavily loaded profile parts.

The invention also provides a piece of furniture provided with at least one leg comprising two telescopically co-acting profile parts provided with a drive as described above. In a preferred application the piece of furniture has at least two length-adjustable legs, wherein the drives of the individual legs are synchronized. There is a particular need for adjustability of furniture legs. For ergonomic and aesthetic reasons among others, little space is available for placing of a drive. Particularly, though not exclusively, envisaged is the use in office furniture such as tables, desks, chairs and so on.

The piece of furniture is preferably provided with a drive which engages on the first profile part such that the toothed wheels are placed under bias between two tooth paths of the first profile part. This results in the absence of permanent play between first profile part and drive. The drive can also be connected in simple manner without play to the second profile part. This increases the rigidity of an assembly of first profile part, drive and second profile part.

The invention also provides a profile part for assembly with the drive as described, provided with at least one longitudinally arranged tooth path, which tooth path is pressed without machining into the profile. The profile part is preferably provided with two internal tooth paths located substantially opposite and parallel to each other. Such a profile part can be manufactured from aluminium or an aluminium alloy. It is found to be financially advantageous to press or roll a tooth path into the profile part. This deformation can be performed cold or hot depending on the material used. While the quality of the pressed tooth path will generally be inferior to that of a machined (for instance mortised or milled) tooth path, in the application according to the invention a deformed tooth path already provides sufficient functionality.

Finally, the invention provides a method for manufacturing a profile part as described in the foregoing by the successive steps of: A) extruding the profile, B) pressing at least one tooth path without machining into the profile, and C) curing the profile with tooth path. The tooth path is herein preferably pressed into the profile in a single production cycle. A tooth path can thus be arranged in the profile in very economic manner.

BRIEF DESCRIPTION OF THE DRAWINGS

The present invention will be further elucidated with reference to the non-limitative embodiments shown in the following figures. Herein.

DETAILED DESCRIPTION OF THE PREFERRED EMBODIMENT

Figure 1A:
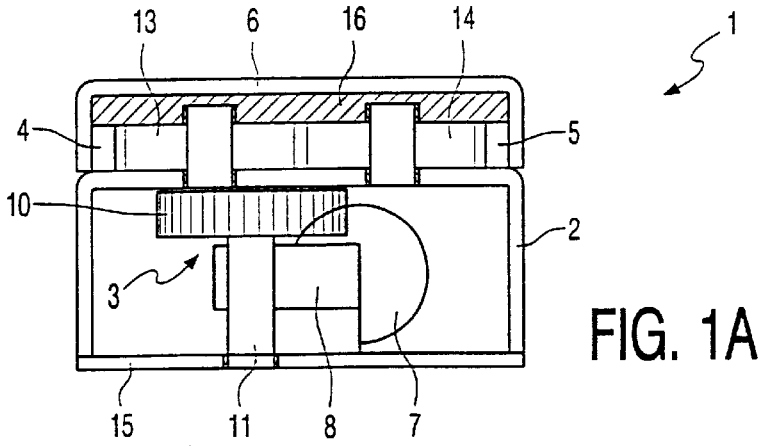
FIG. 1*a* shows a top view of an assembly of a first and second profile part and a drive according to the invention.

FIG. 1*a* shows an assembly 1 of a drive 3 which is connected to a second profile part 2 and which engages on two tooth paths 4,5 forming part of a first profile part 6. Via a right-angled transmission (not shown in this figure) accommodated in a housing 8 a schematically indicated electric motor 7 drives a tooth wheel 9 (see FIG. 1*b*), the axis of which lies perpendicularly of the longitudinal direction of profile parts 2,6.

Figure 1B:
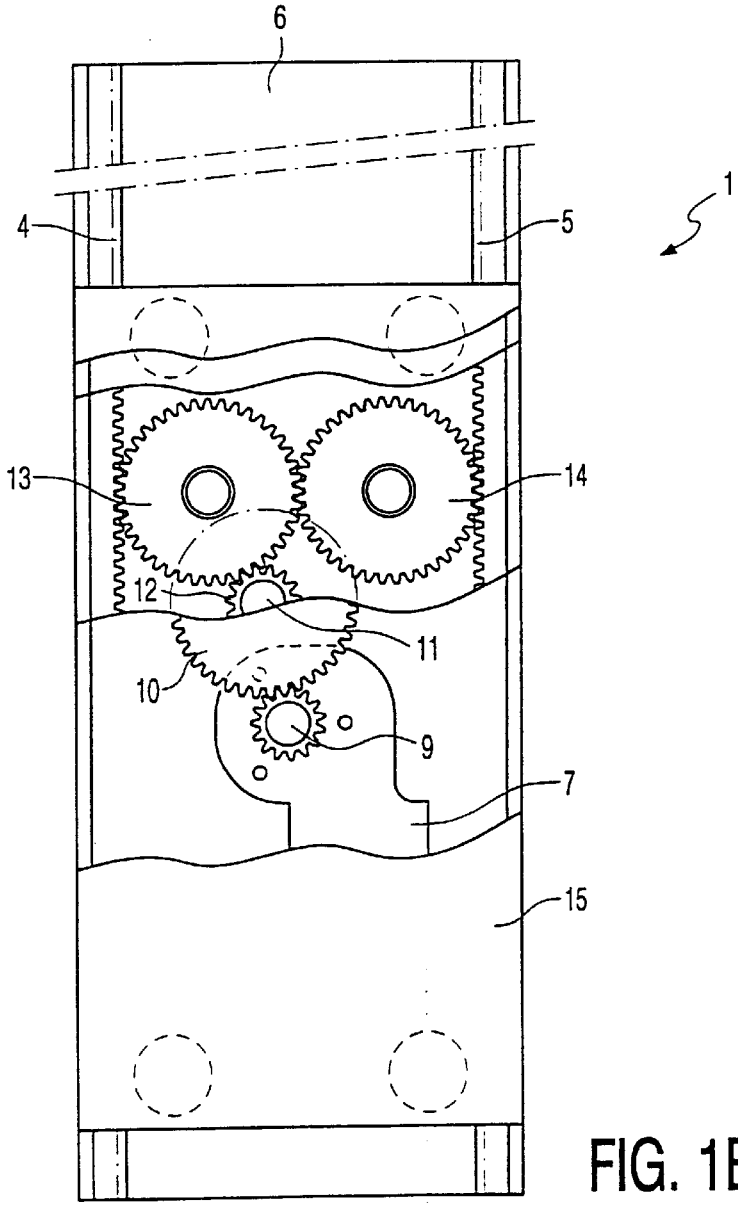
FIG. 1*b* is a partially cut-away side view of the assembly shown in figure 1*a,*

As shown in FIG. 1*b,* tooth wheel 9 engages on a larger tooth wheel 10. A third tooth wheel 12 is fixed to the same shaft 11 as the larger tooth wheel 10. This third tooth wheel 12 is emphatically smaller than the larger tooth wheel 10. The third tooth wheel 12 engages in turn on the larger outer periphery of a toothed wheel 13. Toothed wheel 13 drives an equally large second toothed wheel 14. Toothed wheels 13,14 engage respectively in tooth paths 4,5 of the first profile part 6.

For protection of drive 3 in the U-profile 2 (this is the second profile part 2), this latter is covered with a plate 15. The transmission of respectively the tooth wheels 9, 10, 12, 13, 14 provides drive 3 with a reduction factor. A desired reduction factor can be chosen depending on the type of electric motor 7 and the use of assembly 1. In order to prevent play in the plane through toothed wheels 13,14, these wheels 13,14 are preferably placed under bias between tooth paths 4,5. A guide element 16 is arranged in the first profile part 6 in order to prevent play on toothed wheels 13,14 in axial direction.

Figure 2A:
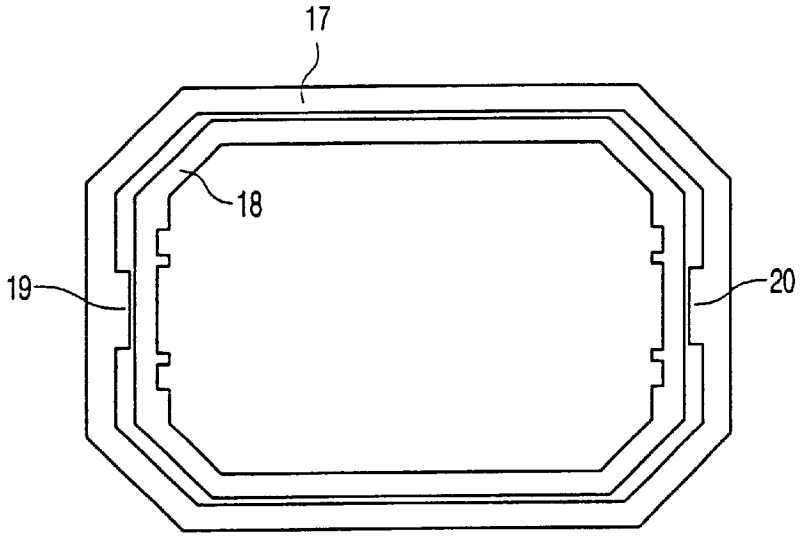
FIG. 2*a* shows a top of view of two telescopic profile parts.

FIG. 2*a* shows a cross-section through a first tubular profile 17 and a second tubular profile 18 slidable therein. The first tubular profile 17 is provided with two internal tooth paths 19,20 for engagement thereon of a drive according to the invention.

Figure 2B:
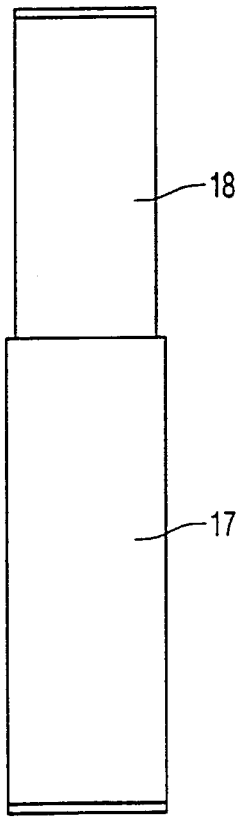
FIG. 2*b* shows a side view of the profile parts shown in FIG. 2*a,* and FIG. 3 shows a schematic side view of a preferred embodiment of the drive according to the invention.

FIG. 2*b* shows a side view of the tubular profile parts 17,18 in a relatively extended situation. A drive 21 to be described with reference to FIG. 3 can be arranged in the second tubular profile 18 so as to change the total length of the two tubular profiles 17,18. The visible sides of tubular profile parts 17,l8 can be embodied completely flat; tooth paths 19,20 are situated on the non-visible inside of the first tubular profile 17. In addition to the fact that this provides visual screening of tooth paths 19,20, they are also protected from fouling and damage.

Figure 3:
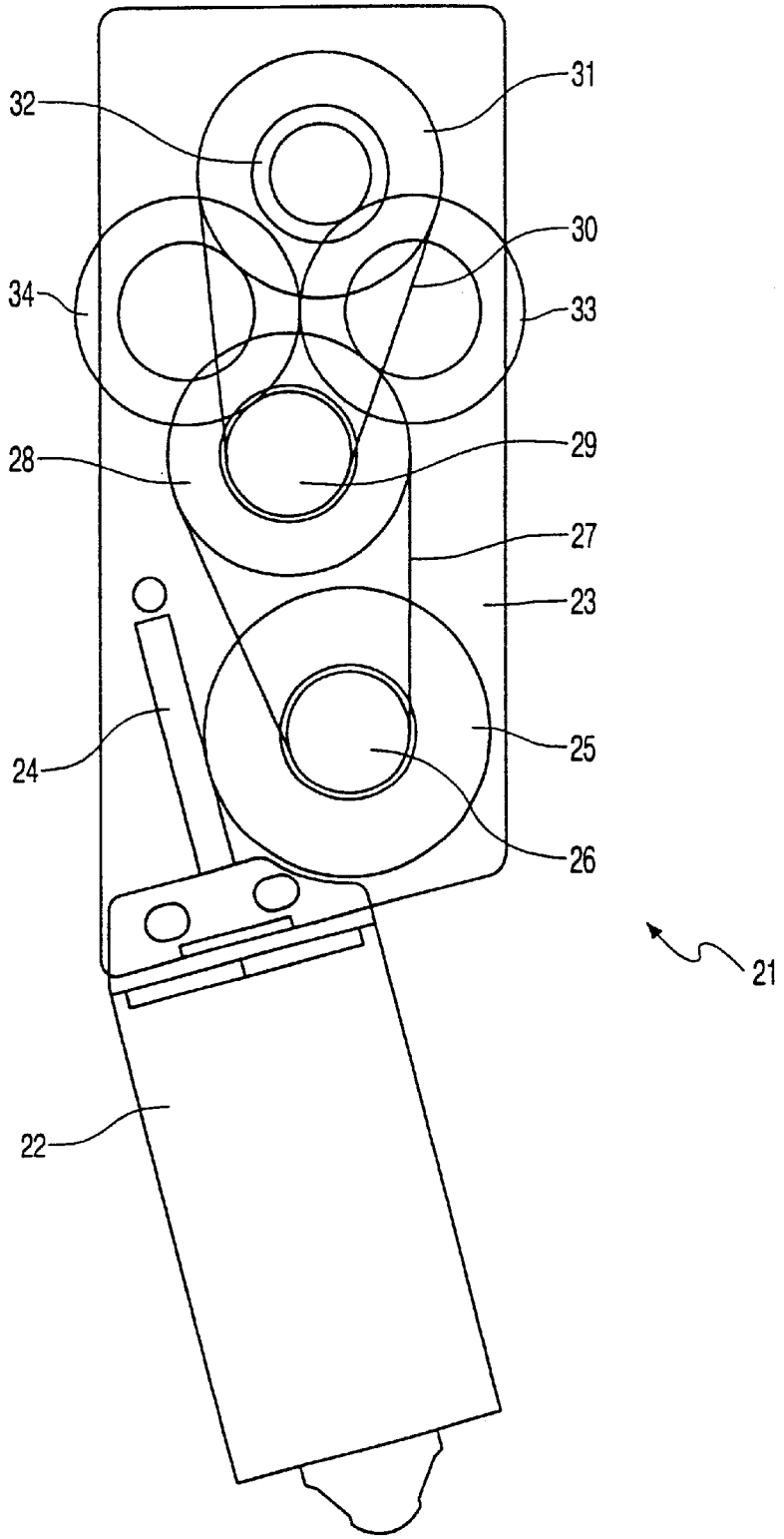

FIG. 3 shows a schematically depicted drive 21 with an electric motor 22 which is fixed to a support plate 23. An output shaft 24 of electric motor 22 engages as pinion on a tooth wheel 25. A tooth wheel 26 of smaller diameter than tooth wheel 25 is mounted on the shaft of tooth wheel 25. Tooth wheel 26 drives a subsequent tooth wheel 28 by means of a chain 27. Similarly to tooth wheel 25, tooth wheel 28 is likewise combined with a smaller tooth wheel 29 which once a gain drives a subsequent tooth wheel 31 with a chain 30. Finally, similarly to tooth wheels 25 and 28, a toothed wheel 33 is driven by a tooth wheel 32 combined with tooth wheel 31. Toothed wheel 33 drives an equally large toothed wheel 34. Toothed wheels 33,34 project to a limited extent from support plate 23. It is precisely where they project that they can engage on tooth paths 19,20 of a first tubular profile 17 (see FIG. 2*a*). Support plate 23 and/or electric motor 22 can be mounted entirely in the second tubular profile, the toothed wheels 33,34 must however protrude outside the second tubular profile 18 such that they can engage on tooth paths 19,20. Slots (not shown) can for instance be milled for this purpose in the second tubular profile 18. It is noted that toothed belts or smooth belts or cords can for instance be applied instead of chains 27,30.

Although the invention is elucidated with reference to only a few embodiments, it sill be apparent to all that the invention is in no way limited to the described and shown embodiments. On the contrary, for the skilled person many other variations are possible within the scope of the invention.

What is claimed is:

1. A drive assembly for mechanically displacing and positioning parts relative to each other, comprising:

a first profile part, a second profile part, at least one tooth path connected to the first profile part, at least one toothed wheel connected rotatably to the second profile part for engaging on the tooth path, drive means, and a transmission mechanism connected to the drive means and to the toothed wheel for transmitting to the toothed wheel the power produced by the drive means, wherein the transmission mechanism is provided with at least one right-angled transmission.

2. The drive assembly as claimed in claim 1, wherein the drive assembly comprises at least two tooth paths and at least two toothed wheels, wherein the toothed wheels are placed substantially parallel to each other, are rotatable in opposing directions and on opposite longitudinal sides of the second profile part engage on respective tooth paths of the first profile part.

3. The drive assembly as claimed in claim 1, wherein the drive means, the transmission mechanism and the toothed wheel are located substantially within the outer periphery of the second profile part.

4. The drive assembly as claimed in claim 1, wherein the second profile part is telescopically movable in and out of the first profile part.

5. The drive assembly as claimed in claim 1, wherein the first profile part is provided with at least two tooth paths which are located substantially opposite and parallel to each other.

6. The drive assembly as claimed in claim 1, wherein the drive means comprise an electric motor.

7. The drive assembly as claimed in claim 1, wherein the drive means are provided with operating means.

8. The drive assembly as claimed in claim 1, wherein the transmission mechanism comprises a reductor formed by toothed wheels and chains.

9. A piece of furniture, comprising at least one leg including:

a first profile part, a second profile part that telescopically co-acts with the first profile part, at least one tooth path connected to the first profile part, at least one toothed wheel connected rotatably to the second profile part for engaging on the tooth path, drive means, and a transmission mechanism connected to the drive means and to the toothed wheel for transmitting to the toothed wheel the power produced by the drive means, wherein the transmission mechanism is provided with at least one right-angled transmission.

10. The piece of furniture as claimed in claim 9, with at least two of said legs, each leg having one of said drives, wherein the drives of the individual legs are synchronized.

11. The piece of furniture as claimed in claim 9, wherein said drive engages on the first profile part such that the toothed wheels are placed under bias between two tooth paths of the first profile part.

12. The drive assembly as claimed in claim 1, wherein the first profile part includes a profile and the at least one tooth path, and the at least one tooth path is longitudinally arranged on the profile and is pressed without machining into the profile.

13. The drive assembly as claimed in claim 12, wherein the first profile part is provided with two internal tooth paths located substantially opposite and parallel to each other.

14. The drive assembly as claimed in claim 12, wherein the first profile part is manufactured from aluminium or an aluminium alloy.

* * * * *

UNITED STATES PATENT AND TRADEMARK OFFICE

CERTIFICATE OF CORRECTION

PATENT NO. : 6,283,422 B1
DATED : September 4, 2001
INVENTOR(S) : Dirk Jan Stoelinga It is certified that error appears in the above-identified patent and that said Letters Patent is hereby corrected as shown below:

Column 4,
Line 16, "once a gain" should read -- once again --.
Line 31, "it still be" should read -- it will be --.

Signed and Sealed this

Nineteenth Day of March, 2002

*Attest:*

*Attesting Officer*

JAMES E. ROGAN
*Director of the United States Patent and Trademark Office*